United States Patent [19]

Lehmann

[11] 4,327,780

[45] May 4, 1982

[54] APPARATUS FOR LOOPING THE OUTERMOST CONVOLUTIONS OF SPIRAL BINDERS

[75] Inventor: Hartmut Lehmann, Nürtingen, Fed. Rep. of Germany

[73] Assignee: Womako Maschinenkonstruktionen GmbH, Nürtingen, Fed. Rep. of Germany

[21] Appl. No.: 156,262

[22] Filed: Jun. 3, 1980

[30] Foreign Application Priority Data

Dec. 13, 1979 [DE] Fed. Rep. of Germany ..... 2950120

[51] Int. Cl.[3] ..... B21F 35/02

[52] U.S. Cl. ..... 140/92.7; 140/103

[58] Field of Search ..... 140/92.3, 92.4, 92.7, 140/103; 11/1 R, 1 A

[56] References Cited

U.S. PATENT DOCUMENTS

| | | | |
|---|---|---|---|
| 3,568,729 | 3/1971 | Freundlich et al. | 140/103 |
| 3,972,109 | 8/1976 | Sickinger | 140/92.7 X |
| 4,095,623 | 6/1978 | Lemburg et al. | 140/92.94 X |

*Primary Examiner*—Gil Weidenfeld
*Assistant Examiner*—Fred A. Silverberg
*Attorney, Agent, or Firm*—Kontler & Grimes

[57] ABSTRACT

A tool which loops the end portion of the outermost convolution of a spiral wire binder around the neighboring next-to-the-outermost convolution while the convolutions of the binder extend through the perforations of a stack of paper sheets and the binder is located in a preselected position has a knife which trims the outermost convolution and thereupon bends the end portion of the outermost convolution to a position of parallelism with and proximity to a stationary surface. A looping device which is mounted at the forward end of a rotary reciprocable shaft is thereupon caused to engage the bent end portion in response to forward movement of the shaft and to loop the bent end portion by moving it along the surface and around the neighboring convolution in response to rotation of the shaft. The shaft is rotatable and reciprocable and the knife is movable by a set of coaxial cams which complete one revolution in order to effect trimming of the outermost convolution, to thereupon effect bending of the end portion of the trimmed convolution and to ultimately effect looping of the bent end portion. The cams are rotatable by a rack and pinion drive through the medium of a one-way clutch.

46 Claims, 13 Drawing Figures

APPARATUS FOR LOOPING THE OUTERMOST CONVOLUTIONS OF SPIRAL BINDERS

BACKGROUND OF THE INVENTION

The present invention relates to spiral binding machines in general, and more particularly to improvements in a method and an apparatus or tool which can be used in such machines to loop the end portions of outermost convolutions of a spiral wire binder which loosely connects the overlapping sheets of a pad, exercise book, calendar, brochure or a like commodity. Still more particularly, the invention relates to improvements in a method and an apparatus which can be used to loop the end portions of outermost convolutions around the neighboring next-to-the-outermost convolutions of spiral binders which consist of metallic or plastic wire.

U.S. Pat. No. 3,568,729 to Freundlich et al. discloses a complex apparatus which is used to loop the end portions of outermost convolutions across the outer sides, thereupon radially inwardly of and finally across the inner sides of the neighboring (i.e., next-to-the-outermost) convolutions of spiral binders. The patented apparatus can form loops when the machine which embodies such apparatus is operated at a low speed, particularly at a speed which is sufficiently low to permit for manual insertion of spiral binders subsequent to introduction of such binders into the perforations of a note book, pad or the like. However, once the apparatus of the patent to Freundlich et al. is incorporated in a machine which is designed for automatic threading of spiral binders into stacks of paper sheets or the like and for subsequent looping of the end portions of outermost convolutions, the formation of loops is unsatisfactory or the parts of the apparatus break or fail to loop the end portion of outermost convolutions around the neighboring (next-to-the-outermost) convolutions.

U.S. Pat. No. 4,095,623 to Lemburg et al. discloses a different loop forming apparatus which is capable of forming acceptable loops at an elevated speed of the machine wherein the apparatus is installed and which serves to convert a length of wire into a succession of spiral binders which are threaded into the perforations of successive note books or the like prior to automatic looping of portions of both end convolutions on each spiral binder. This is attributed, to a certain degree, to the fact that the apparatus of Lemburg et al. defines a channel wherein the end portion of the outermost convolution is guided during bending and looping to thus ensure that each and every end convolution can be adequately deformed and that the loops into which the end portions of the outermost convolutions are converted assume a predetermined optimum shape, be it in the form of fully closed or in the form of partly open loops which extend along the outer sides of the neighboring next-to-the-outermost convolutions, thereupon inwardly toward the axis of the spiral binder and finally outwardly along the inner sides of the neighboring convolutions. The channel is defined by a turnable loop forming device in combination with a hold-down device which is movable with respect to the loop forming device. The purpose of the hold-down device is to prevent the end portion of the outermost convolution from slipping off an eccentric portion of the loop forming device so that the latter invariably engages and loops the end portion in order to form a loop of desired size and shape. In the absence of the hold-down device, the end portion of the outermost convolution would be likely to slide off the aforementioned eccentric portion because the end portion is of arcuate shape. The apparatus of Lemburg et al. is highly reliable and can make loops of predictable shape on the additional ground that the movements of the aforediscussed loop forming and hold-down devices are properly synchronized with movements of a combined trimming or clipping and bending device which removes the surplus of wire from the outermost convolution of a spiral binder and bends the free end portion of the trimmed outermost convolution so that the end portion is moved into a plane which includes the axis of the spiral binder and such end portion then overlies the outer side of the neighboring (next-to-the-outermost) convolution.

A machine which utilizes the apparatus of Lemburg et al. must be provided with at least one set of apparatus, i.e., with a first apparatus which loops the end portion of one end convolution and with a second apparatus which loops the end portion of the other end convolution of a spiral binder. The dimensions of the combined trimming and bending, hold-down and loop forming devices must be selected with a view to match the diameter of the spiral binder which is to be treated by such devices. If the machine which utilizes the apparatus of Lemburg et al. is to make, insert and loop the ends of larger- or smaller-diameter spiral binders, the two apparatus which are installed in the machine are replaced with a set of apparatus whose devices are designed to trim, bend, hold down and loop the end portions of such different spiral binders. Therefore, each machine which embodies the apparatus of Lemburg et al. is furnished with several sets of loop forming apparatus in order to enhance the versatility of the machine and to thus enable the manufacturer to make, insert and shape the end portions of end convolutions of a wide range of spiral binders including those which are used to loosely connect a relatively small number or those which are used to loosely connect a relatively large number of paper sheets or the like to form articles known as spiral bound steno pads, exercise books or like stationery products.

It is conceivable to furnish each loop forming apparatus of Lemburg et al. with several sets of trimming and bending, hold-down and loop forming devices, i.e., to enable a mechanic or another attendant to convert such apparatus for the looping of end portions of outermost convolutions of large-, medium- or small-diameter spiral binders. However, such conversion of loop forming apparatus would consume much time; therefore, the previously described solution according to which the spiral binding machine is furnished with two or more sets of loop forming apparatus is considered to be more acceptable to the manufacturers of spiral bound note books or like commodities. Furthermore, convertible loop forming apparatus would have to be assembled and dismantled by trained mechanics, and the owner of the spiral binding machine would have to keep in stock a substantial supply of spare parts for each loop forming apparatus.

OBJECTS AND SUMMARY OF THE INVENTION

An object of the invention is to provide a novel and improved method of looping the end portions of outermost convolutions of spiral wire binders around the neighboring convolutions.

Another object of the invention is to provide a novel and improved loop forming apparatus which can be used in spiral binding machines as a superior substitute for heretofore known loop forming apparatus.

An additional object of the invention is to provide a loop forming apparatus which is more versatile than heretofore known apparatus, which can form adequate loops at the ends of outermost convolutions of large-, medium- or small-diameter spiral binders, and which can be installed in certain existing spiral binding machines as a more versatile but just as reliable or even more reliable substitute for the latest versions of conventional loop forming apparatus.

A further object of the invention is to provide a loop forming apparatus which comprises a surprisingly small number of component parts, which is capable of reliably looping the end portions of outermost convolutions of spiral binders at a frequency at least matching the frequency which can be achieved by resorting to heretofore known loop forming apparatus, and which is provided with novel and improved means for synchronizing the movements of its mobile constituents so as to ensure that such constituents move in a given sequence and cannot impinge upon each other, cause damage to each other or undergo unnecessary wear.

An additional object of the invention is to provide novel and improved means for imparting motion to the trimming, bending and loop forming devices of the improved loop forming apparatus.

Another object of the invention is to provide the above outlined apparatus with novel and improved means for guiding and locating portions of a spiral binder during the making of loops as well as preparatory to looping.

One feature of the invention resides in the provision of an apparatus which constitutes a tool serving to loop the end portion of the outermost convolution around the neighboring next-to-the-outermost convolution of a spiral wire binder whose convolutions extend through the marginal perforations of a stack of overlapping paper sheets or the like. The improved apparatus or tool comprises means (e.g., two toothed or pronged positioning members and a shroud) for locating the binder in a predetermined position, guide means (such guide means may support, constitute or comprise one of the aforementioned positioning members) having a surface (such surface may but need not be entirely flat or it may include flat and curved portions) at least a portion of which is located in a predetermined plane, means for bending the end portion of the outermost convolution of the binder in the predetermined position outwardly and over the neighboring convolution so that the thus bent end portion is adjacent to the aforementioned portion of the surface of the guide means (the bending means may form part of a device which trims or clips the outermost convolution prior to bending so as to ensure that the apparatus will form a loop of predetermined size and shape), and means for looping the thus bent end portion of the outermost convolution around the neighboring convolution of the binder in the predetermined position. The looping means includes a device which is movable toward and away from the aforementioned portion of the surface of the guide means (preferably substantially at right angles to the plane of such portion of the surface) to and from an extended position of engagement with the bent end portion of the outermost convolution and which is also rotatable or turnable about a predetermined axis which is inclined (preferably normal) with respect to the axis of the binder in the predetermined position and is substantially normal to the portion of the surface. The apparatus further comprises a first rotary cam or other suitable means for moving the device toward and away from the surface of the guide means, and a second rotary cam or other suitable means for rotating the device about the predetermined axis to thereby loop the bent end portion along the aforementioned portion of the surface of the guide means and around the neighboring convolution of the binder in the predetermined position.

The device of the looping means preferably comprises a removable shaft which is reciprocable in directions toward and away from the aforementioned portion of the surface of the guide means and one end portion of which (namely, that end portion which is nearer to the guide means) carries or constitutes an eccentric or diametrically extending wire-engaging portion which loops the bent end portion of the outermost convolution of the spiral binder while the first cam means maintains the aforesaid device of the looping means in the extended position.

Another feature of the invention resides in the provision of a method of looping the end portion of the outermost convolution around the neighboring convolution of a spiral wire binder whose convolutions extend through the marginal perforations of a stack of paper sheets or the like. The method comprises the steps of locating the binder in a predetermined position with reference to a first plane (namely, the plane of the aforementioned portion of the surface of the guide means), bending the end portion of the outermost convolution of the binder in such predetermined position outwardly of and over the neighboring convolution so that the thus bent end portion of the outermost convolution is adjacent to the first plane, and looping the thus bent end portion of the outermost convolution around the neighboring convolution of the binder in the predetermined position. The looping step includes moving a second plane (preferably the plane of a selected surface on the aforementioned rotary device of the looping means) toward the first plane, confining the bent end portion of the outermost convolution between the first and second planes, and rotating one of the planes (preferably the second plane) with reference to the other plane about an axis which is substantially normal to the other plane.

The two planes are preferably parallel or substantially parallel to each other to define a channel wherein the bent end portion of the outermost convolution is confined during looping. The first plane is preferably the plane of a portion of or an entire surface which is stationary during clipping or trimming, bending and looping, and the second plane may constitute the end face of a rotary shaft which defines the aforementioned axis. The first plane is preferably stationary while the binder is located in the predetermined position.

The novel features which are considered as characteristic of the invention are set forth in particular in the appended claims. The improved loop forming apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
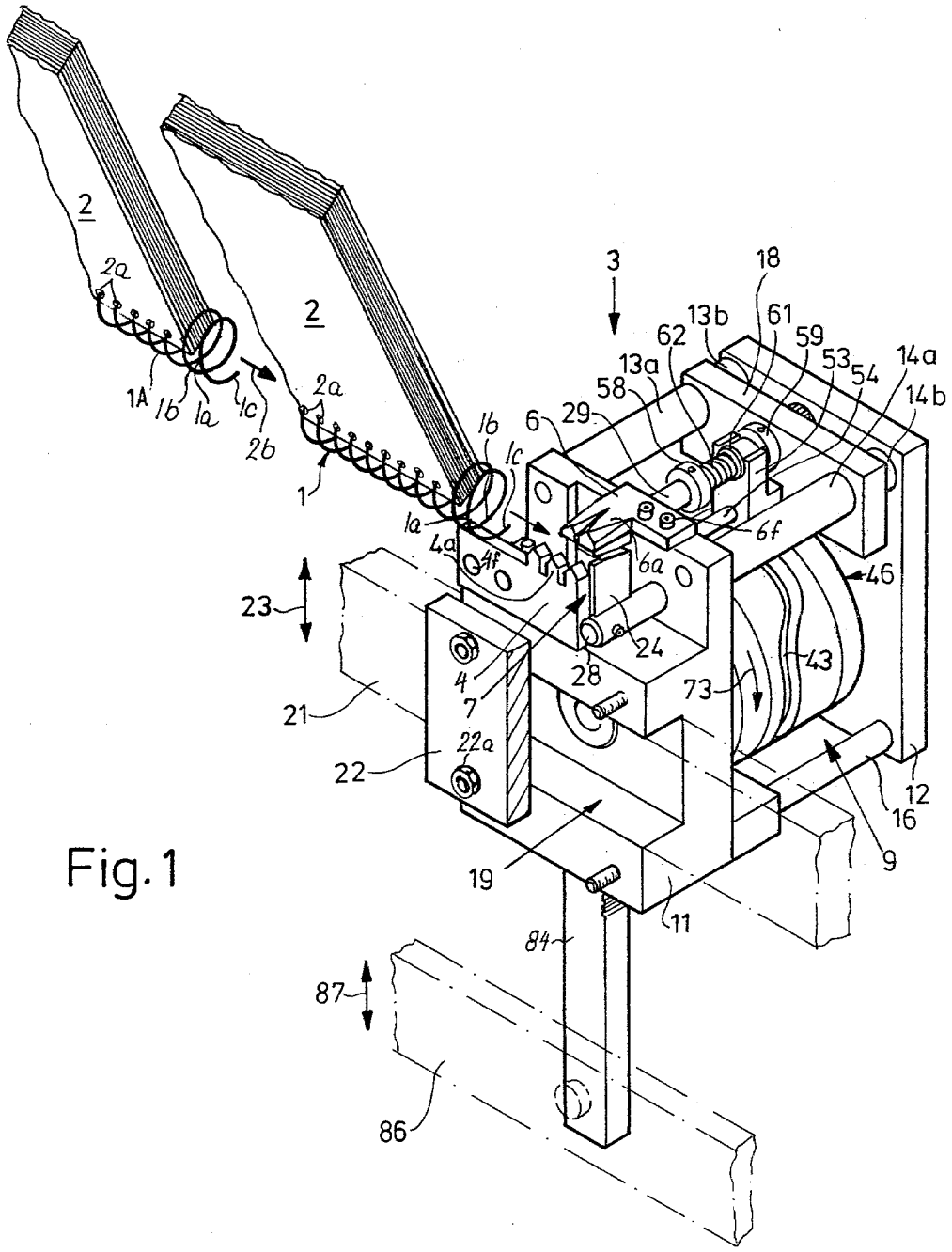
FIG. 1 is a perspective view of a loop forming apparatus which embodies the invention, with one of a series of spiral binders shown in the process of being introduced into the apparatus preparatory to looping of the end portion of the front outermost convolution of such binder, certain parts of the apparatus being shown by phantom lines for the sake of clarity.
Figure 2:
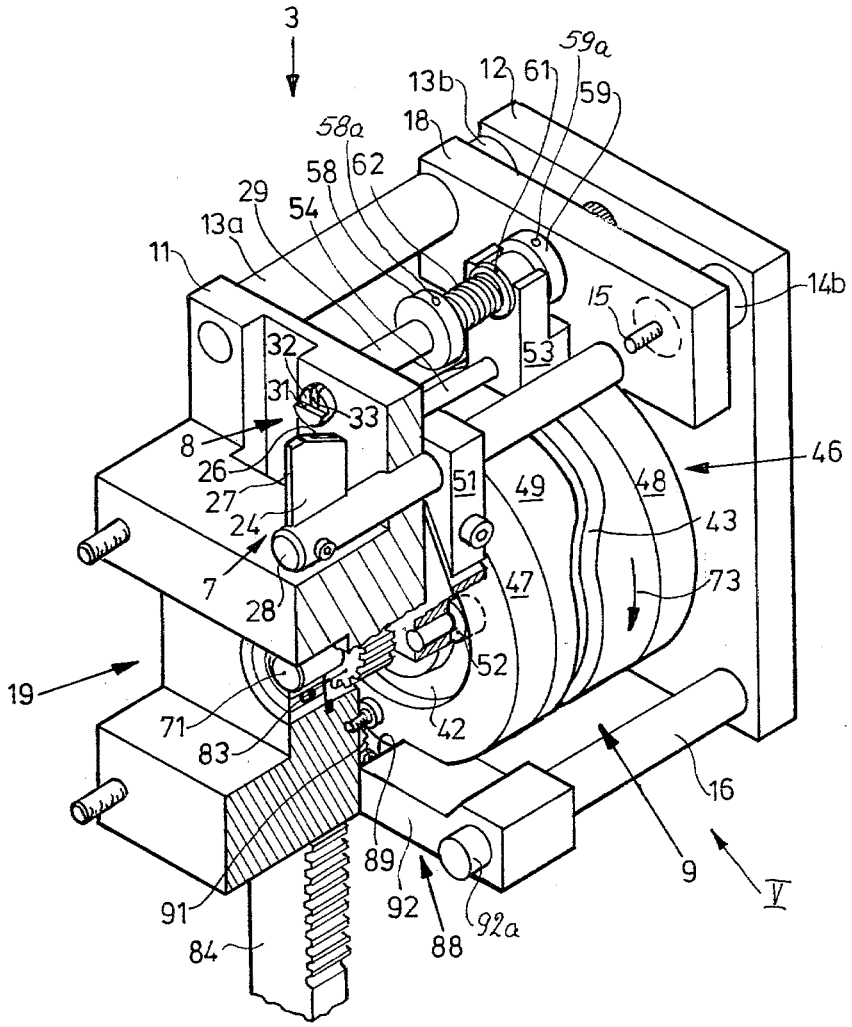
FIG. 2 is an enlarged view of the loop forming apparatus, with certain parts broken away to expose the means for transmission of torque to the cams of the means which serve to move the loop forming and combined trimming and bending devices of the improved apparatus.
Figure 3:
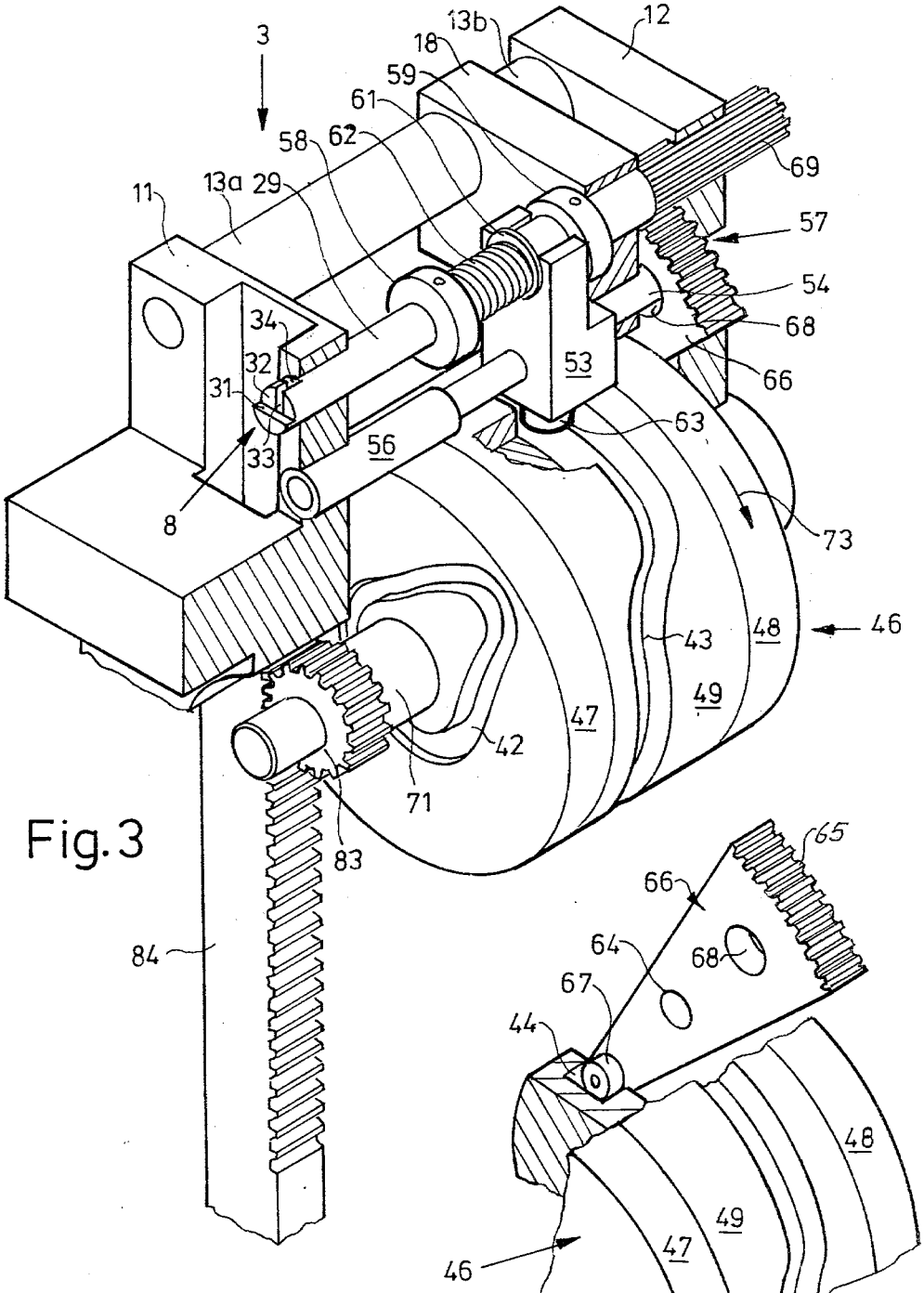
FIG. 3 is an enlarged view of the apparatus which is shown in FIG. 2, with certain parts broken away to show the means for operatively connecting two of the cams with the loop forming device.
Figure 7:
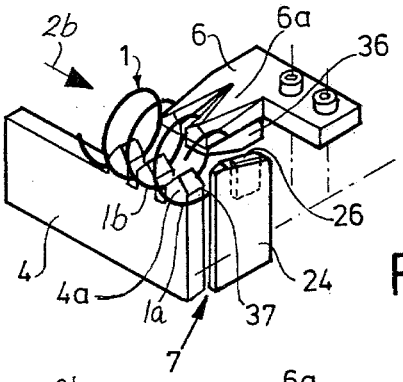
FIG. 7 is a perspective view of a detail showing the means for locating a spiral binder preparatory to looping of the end portion of one of its outermost convolutions.
Figure 7A:
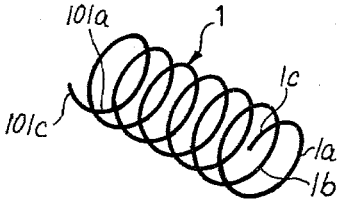
FIG. 7*a* is a perspective view of a spiral binder in a position it assumes when it is properly held by the locating means of FIG. 7.
Figure 9:
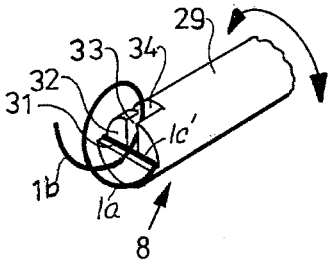
FIG. 9 is an enlarged fragmentary perspective view of the loop forming device in an angular position it assumes prior to looping of the bent end portion of the outermost convolution.
Figure 9A:
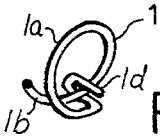
FIG. 9*a* shows the structure of FIG. 8*a* upon completion of the loop forming step.
Figure 10:
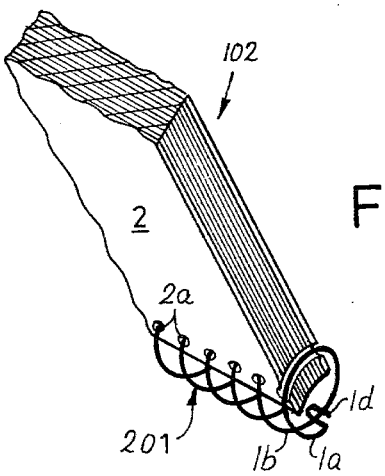
FIG. 10 is a fragmentary perspective view of a note book with the illustrated end convolution deformed in a manner as shown in FIG. 9*a*.

Referring first to FIGS. 1 to 3, there is shown an apparatus which serves to convert the end portions 1*c* of outermost convolutions 1*a* of spiral binders 1 into loops, e.g., into partly open loops 1*d* of the type shown in FIGS. 9*a* and 10. The spiral binders 1 consist of wire, preferably metallic wire, and are formed in a so-called spiral binding machine, e.g., a machine of the type known as 530 S produced and sold by the assignee of the present application. The spiral binding machine is provided with means for drawing wire from a barrel or another suitable source of supply, for converting such wire into a continuous spiral, for threading the leader of the continuous spiral through the perforations 2*a* in marginal portions of successive accumulations or stacks 2 of overlapping paper sheets, and for severing the continuous spiral behind each stack 2 so that the spiral yields a succession of discrete binders 1 whose outermost convolutions 1*a* and 101*a* are configurated in a manner as shown in FIG. 1 or 7*a*. The direction in which successive stacks 2 are advanced into the range of the illustrated loop forming apparatus is indicated by the arrow 2*b*. FIGS. 1 to 3 merely show one of two associated apparatus, namely, that apparatus which serves to loop the end portions 1*c* of the front outermost convolutions 1*a* of successive spiral binders 1. A similar second apparatus is disposed to the left of the illustrated apparatus, as viewed in FIGS. 1 to 3, to trim or clip and bend and thereupon loop the end portion 101*c* of the rear outermost convolution 101*a* (see FIG. 7*a*) simultaneously with analogous treatment of the front outermost convolution 1*a* by the illustrated apparatus. This ensures that the treatment of the end portions 1*c*, 101*c* of both end convolutions 1*a*, 101*a* is completed simultaneously so that the commodity 102 (see FIG. 10) which issues from the spiral binding machine is a note book or a like product whose spiral binder 201 exhibits two looped end convolutions. This reduces the likelihood of injury to a user as well as the likelihood of entanglement of neighboring spiral binders 201 during storage, transport to a stacking station, wrapping into cellophane or any other treatment which follows the formation of loops. The spiral binding machine comprises suitable means for advancing the stacks 2 from station to station including the step of moving successive stacks and their binders 1 into register with the two loop forming apparatus. In the aforementioned spiral binding machine of the type known as 530 S, the advancing means is designed to move the stacks 2 in stepwise fashion from a station where the stacks are inserted (either by hand or automatically), to a station where the stacks are formed with perforations 2*a* (either in a single step or in several steps, depending on the thickness of the stacks 2, on the thickness of their sheets, on the presence or absence of cover sheets, and/or certain other factors), to a station where the marginally perforated stacks are located in the range of the aforementioned continuous spiral so that the latter can be threaded through the perforations 2*a* of successive stacks 2 by rotating about its own axis, to a station where the spiral is severed to yield discrete binders 1, and on to the station which accommodates the improved apparatus as well as the associated second loop forming apparatus. The two loop forming apparatus are disposed mirror symmetrically with reference to each other. Each loop forming apparatus is installed in a predetermined position so that its inclination with reference to the path of movement of stacks matches or approximates the lead of the respective spiral binders.

The illustrated loop forming apparatus comprises a frame or main support 3 which carries a locating unit including two sets of prongs or teeth 4*a* and 6*a*. These prongs are respectively integral with plate-like guide members 4 and 6 which are disposed in two mutually inclined planes (see also FIGS. 5, 7 and 8). The distances between the tooth spaces which are defined by the prongs 4*a* or 6*a* equal the spacing of neighboring convolutions of a spiral binder 1 so that the latter can be held in a predetermined position (shown in FIG. 7 or 8) when its convolutions extend into such tooth spaces. The frame 3 further carries a mobile combined trimming or clipping and bending device 7 as well as a rotary and reciprocable looping device 8. Furthermore, the frame 3 supports several components of a driving unit 9 which imparts motion to the devices 7 and 8.

The frame 3 comprises a plate-like front wall 11, a plate-like rear wall 12 and a plate-like intermediate wall 18. The walls 11, 12 and 18 are held at a preselected distance from and are secured to each other by distancing sleeves 13*a*, 13*b*, 14*a*, 14*b*, 16 and 17 as well as bolts or screws, some of which are shown at 15. The sleeves 13*a*, 14*a* are disposed between the walls 11 and 18, the sleeves 13*b*, 14*b* are disposed between the walls 18 and 12, and the sleeves 16, 17 are disposed between the walls 11 and 12.

The front side of the front wall 11 has a horizontal groove 19 for an elongated carrier rail 21 which is held in the groove 19 by a plate-like lid 22. The latter is separably fastened to the front wall 11 by bolts 22*a* or the like so that an attendant can rapidly detach the entire frame 3 from the rail 21. The rail 21 is movable up and down, as viewed in FIG. 1 (see the double-headed arrow 23), by the prime mover of the aforediscussed spiral binding machine so that the entire frame 3 can be moved between a retracted or lower end position and an operative or upper end position.

Figure 5:
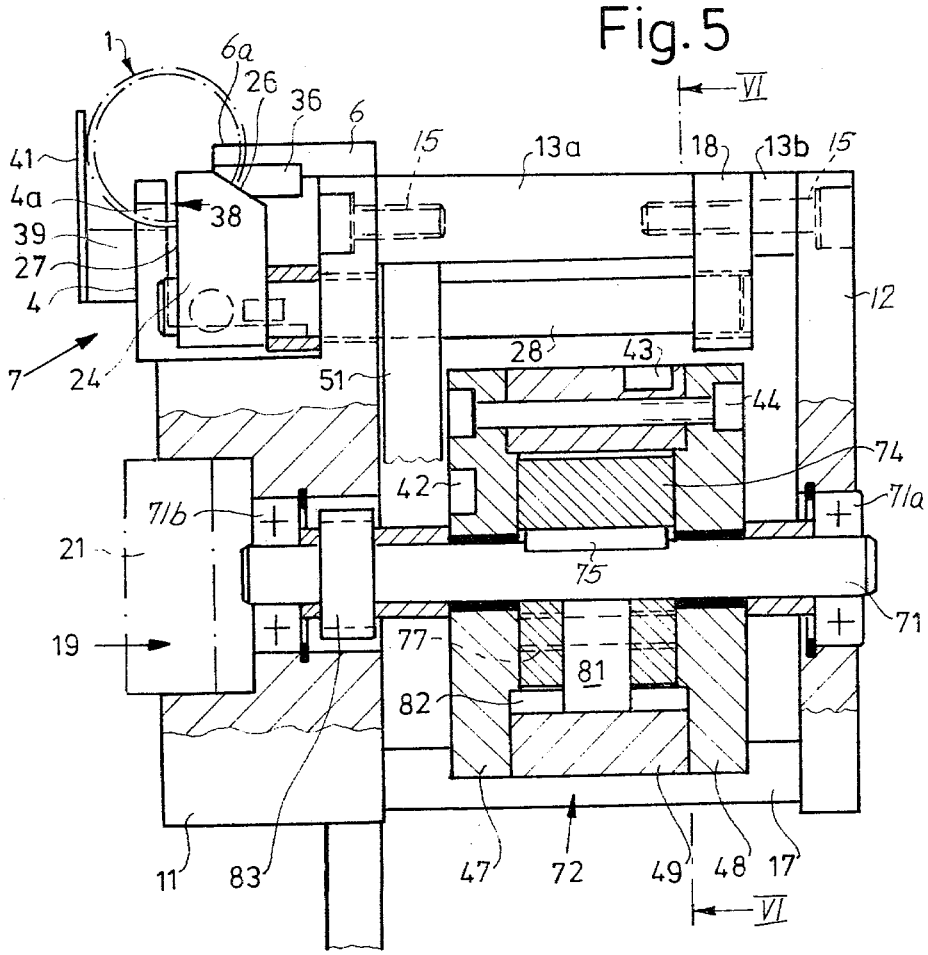
FIG. 5 is a side elevational view as seen in the direction of arrow V in FIG. 2, with certain parts broken away to show the construction of the clutch which transmits torque to the cams.
Figure 8:
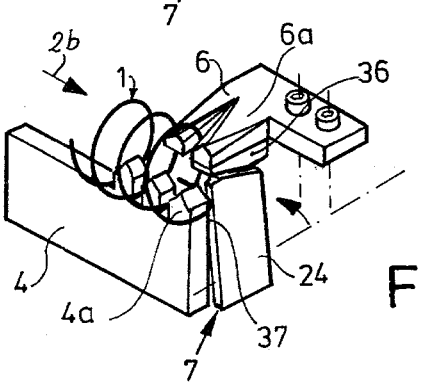
FIG. 8 is a perspective view of the structure of FIG. 7, the combined trimming and bending device being shown in a position it assumes upon completion of the trimming and bending operations.

The combined trimming or clipping and bending device 7 comprises a knife 24 which is a plate-like element and extends radially from a shaft 28 which is journalled in the frame 3. The knife 24 has a cutting edge 26 which is preferably defined by a suitably configurated hard-metal insert (indicated in FIG. 2) separably attached to or inserted into the knife 24 so as to allow for convenient replacement in the event of excessive wear or pronounced dulling of the cutting edge 26. The just mentioned insert can be separably secured to the knife 24 by soldering or by resorting to another suitable technique. The knife 24 is further provided with a bending portion or edge 27 which extends radially of the shaft 28 and serves to bend the freshly trimmed end portion 1*c* of the front outermost convolution 1*a* of a spiral binder 1 whose convolutions extend into the spaces between the locating prongs 4*a*, 6*a* in a manner as illustrated in FIGS. 5, 7 and 8. The cutting edge 26 removes the surplus (if any) from the end portion 1*c* so that the latter can be converted into a loop 1*d* (see FIGS. 9*a* and 10) of predetermined size and shape. The shaft 28 for the knife 24 is rotatable in the front wall 11 and intermediate wall 18 of the frame 3. This shaft can extend into the distancing sleeve 14*a*.

The loop forming device 8 includes a shaft 29 which is parallel to the shaft 28. The end face or surface 32 on the front end portion of the shaft 29 has a diametrically or substantially diametrically extending wire-engaging and looping shoulder or ledge 31 which projects forwardly of the wall 11 and can engage the bent end portion 1*c*′ of the outermost convolution 1*a* when the shaft 29 is moved axially to the extended position shown in FIG. 9. In the next step, the shaft 29 is rotated whereby the ledge or shoulder 31 converts the bent end portion 1*c*′ into the aforementioned loop 1*d* which is shown in FIGS. 9*a* and 10. The front end face 32 of the shaft 29 is further formed with a composite socket including a substantially radially extending slot 33 whose inner end portion communicates with a circumferentially extending recess or undercut 34 (see FIGS. 3 and 9). Such configuration of the composite socket 33, 34 renders it possible to rotate the shaft 29, in the extended position of the shaft, for the purpose of converting the bent end portion 1*c*′ into the loop 1*d*. Moreover, the socket 33, 34 renders it possible to move the shaft 29 between the extended and retracted positions. In the extended position, the front end portion of the shaft 29 projects into the spiral binder 1 if the latter is properly located by the prongs 4*a* and 6*a*. The angular movement of the shaft 29, in the extended position of this shaft, suffices to deform a part of the bent end portion 1*c*′ through approximately 180 degrees about the next-to-the-outermost convolution 1*b*. The length of the recess 34, as considered in the circumferential direction of the shaft 29, suffices to allow for unimpeded formation of the loop 1*d*, i.e., this recess normally extends along an arc of at least 180 degrees.

The shaft 29 is rotatably and axially movably journalled in the walls 11, 18 and 12 of the frame 3. Thus, the walls 11, 18 and 12 constitute (or comprise) bearings for the shaft 29. The shoulder 31 is normally (but need not be) slightly eccentric, i.e., it is normally spaced apart from the axis of the shaft 29.

The apparatus further comprises a stationary counterknife 36 for the mobile knife 24 of the combined trimming or clipping and bending device 7. The counterknife 36 is a relatively small plate which is preferably made of hardened metallic stock and is separably attached to the underside of the last or outermost prong 6*a* (see FIGS. 7 and 8). For example, the counterknife 36 can be soldered to the guide member 6 which is provided with the prongs 6*a*. The guide member 4 has an inner surface 38 (FIG. 5) which is substantially flat. The entire surface 38 need not be flat, it suffices if a portion of this surface is flat in the region which is adjacent to the end face 32 of the shaft 29, and the plane of such portion of the surface is preferably normal or nearly normal to the axis of the shaft 29 and to the plane of the shoulder 31. The surface 38 is adjacent to and is disposed at the level of but can also extend below the prongs 4*a*, as viewed in FIGS. 1–3 and 7–8. The outermost or last prong 4*a* of the locating means for the spiral binder 1 defines an upright bending edge 37 which cooperates with the edge 27 of the knife 24 to bend the end portion 1*c* into a plane adjacent to the aforementioned portion of the surface 38 when the shaft 28 is rotated to move the knife 24 from the position shown in FIG. 7 (the cutting edge 26 is about to sever the outermost convolution 1*a* to remove the surplus) to the position of FIG. 8 in which the trimmed or clipped end portion 1*c* is adjacent to the plane of the aforementioned portion of the surface 38 and is thus located in the path of movement of the shaft 29 to its extended position. The trimmed or clipped end portion 1*c* is bent around the edge 37 of the guide member 4. While the shaft 29 turns (in the extended position), it causes the shoulder 31 to travel along the surface 38 whereby the latter prevents the bent end portion 1*c*′ from sliding off the shoulder 31 in a direction away from the end face 32 of the shaft 29. It can be said that the planes of the end face 32 and surface 38 define a relatively narrow channel or passage whose width equals or slightly exceeds the diameter of the wire of which the spiral binder 1 is made and wherein the end portion 1*c*′ is confined subsequent to trimming or clipping and bending by the device 7 and subsequent to movement of the shaft 29 to its extended position. The plane of the end face 32 rotates relative to the plane of the surface 38 in the course of the looping operation. The surface 38 is stationary as long as the binder 1 is located in the predetermined position which is determined by the prongs 4*a*, 6*a* and a shroud 41, i.e., the plane of the surface 38 is stationary in the course of the clipping, bending and looping operations. The plane of the end face 32 rotates about the axis of the shaft 29.

As shown in FIG. 5, the front wall 11 of the frame 3 carries a readily detachable distancing element 39 for the aforementioned shroud 41 which may be made of sheet metal and steers the convolutions of the foremost spiral binder 1 into the spaces between the prongs or teeth 4*a* and 6*a* while the rail 21 moves upwardly to lift the frame 3 to the operative position of FIG. 5. The outline of the foremost spiral biner 1 (in the predetermined position of such binder) is indicated in FIG. 5 by phantom lines. The foremost convolutions (e.g., two or three foremost convolutions) of the foremost binder 1 extend into the spaces between the prongs 4*a* in the region between the six and seven o'clock positions, as viewed in FIG. 5. The outermost convolution 1*a* of the foremost spiral binder 1 extends into the space between the two prongs 6*a* of the guide member 6 between the three and four o'clock positions, as viewed in FIG. 5. If desired, the number of prongs 4*a* can be increased above or reduced to less than three, and the number of prongs 6*a* can be increased above two.

FIG. 5 further shows that, when the foremost spiral binder 1 is properly positioned so that the end portion 1*c* of its outermost convolution 1*a* is ready to be converted into a loop 1*d*, such binder is located by the prongs 4*a*, 6*a* as well as by the shroud 41 so that its axis (extending at right angles to the plane of FIG. 5) is normal to the axes of the shafts 28 and 29.

Figure 4:
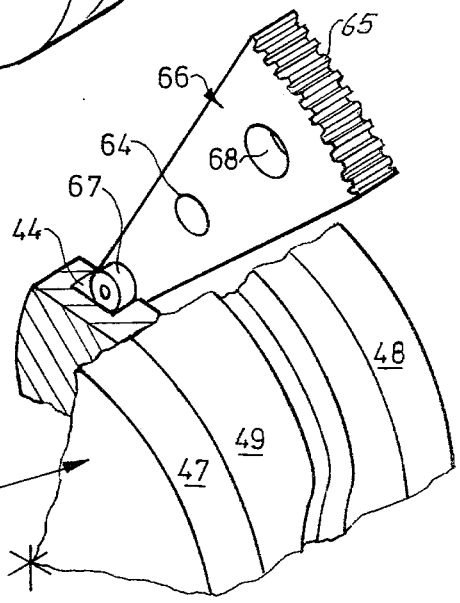
FIG. 4 is an enlarged perspective view of a detail in the apparatus of FIG. 3.

The driving unit 9 for the shafts 28 and 29 includes a composite hollow rotary cam 46 which is assembled of two coaxial discs 47, 48 and a cylinder 49 between the two discs. The exposed end face of the front disc 47 has a first endless cam groove 42 which receives the roller follower 52 of a first motion transmitting unit serving to turn the shaft 28 back and forth in response to rotation of the composite cam 46 about an axis which is parallel to the axes of the shafts 28 and 29. The endless cam groove 43 in the peripheral surface of the cylinder 49 receives the follower 63 of a second motion transmitting unit which serves to move the shaft 29 axially to and from the extended position, i.e., at right angles to the plane of the guide surface 38. The rear disc 48 has an exposed end face provided with an endless cam groove 44 (see FIG. 4) for the roller follower 67 of a third motion transmitting unit which serves to rotate the shaft 29 and to thereby enable the shoulder 31 to convert the bent end portion 1*c*' of the outermost convolution 1*a* of a spiral binder 1 which is held in the predetermined position of FIG. 5 into a loop 1*d*.

Figure 6:
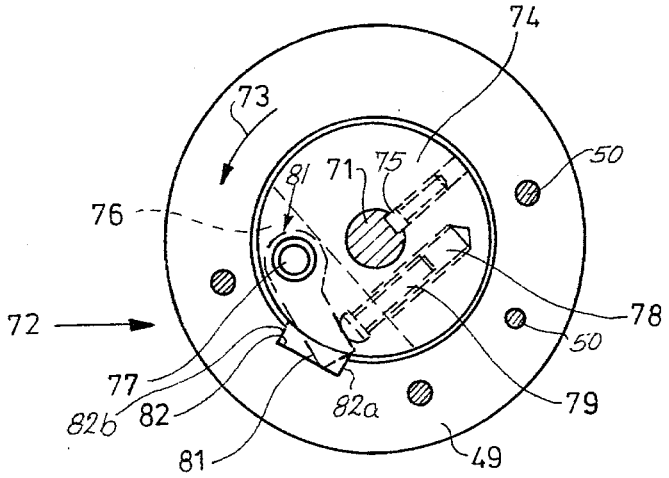
FIG. 6 is a sectional view of the clutch as seen in the direction of arrows from the line VI—VI in FIG. 5.

The first motion transmitting unit further includes a lever 51 (see FIG. 2) which is fixedly secured to the shaft 28 at the inner side of the wall 11 and whose free end supports the aforementioned roller follower 52. The disc 47 can be said to constitute a heart cam whose groove 42 has at least one endless surface or cam face which guides the follower 52 so that the latter causes the knife 24 to move from and back to a starting position in response to each full revolution of the disc 47. The means for coaxially securing the discs 47, 48 to the respective end faces of the centrally located cylinder 49 of the composite cam 46 includes screws, bolts or other suitable fastener means 50 (see FIG. 6). The components 47, 48 and 49 of the composite cam 46 are coaxial with and can be rotated in a single direction, by a camshaft 71 through the medium of a one-way clutch 72 (e.g., a suitable freewheel) which is illustrated in FIGS. 5 and 6.

The second motion transmitting unit includes the aforementioned follower 63 (see FIG. 3) in the endless groove 43 of the cylinder 49, a bifurcated motion transmitting lever 53 which is affixed to an intermediate shaft 54, two annular stops 58, 59 which are adjustably but fixedly secured to spaced-apart portions of the shaft 29 between the walls 11 and 18, and a helical spring 62 or other suitable resilient means which reacts against the stop 58 and bears against a washer 61 which urges the bifurcated portion of the lever 53 against the stop 59. The bifurcated portion of the lever 53 straddles the shaft 29 between the washer 61 and the stop 59 so that the shaft 29 is moved axially when the follower 63 tracks the cam face in that portion of the cam groove 43 which has a component extending in the axial direction of the camshaft 71.

The intermediate shaft 54 for the lever 53 is reciprocable in the wall 18 as well as in an elongated bearing sleeve 56 which is mounted in the front wall 11 of the frame 3. The rear wall 12 has an opening 57 (see FIG. 3) which registers with the shaft 54 so that the latter has sufficient freedom of axial movement to and from that position in which the shaft 29 is fully retracted.

The helical spring 62 allows for a certain amount of movement of the lever 53 relative to the shaft 29 (as considered in the axial direction of the shaft 54) in order to reduce the likelihood of damage to the apparatus if a spiral binder is not properly located when the lever 53 tends to move the shaft 29 to the extended position and/or when the shaft 29 is rotated by the disc 48 of the composite cam 46 in order to convert the bent or presumably bent end portion 1*c*' of the outermost convolution 1*a* into a loop 1*d*. The likelihood of improper seating of the foremost spiral binder 1*a* in the space defined by the prongs 4*a*, 6*a* and shroud 41 in the raised position of the frame 3 is quite remote; therefore, the spring 62 constitutes an optional feature of the improved apparatus.

The rear wall 12 of the frame 3 carries a shaft 64 (see FIG. 4) for a two-armed lever 66 one arm of which is a gear (preferably a gear segment) 65 and the other arm of which carries the aforementioned roller follower 67 extending into the endless groove 44 of the disc or heat cam 48 of the composite rotary cam 46. The gear segment 65 of the lever 66 has a bore or hole 68 for the intermediate shaft 54, and this segment meshes with an elongated gear 69 which is secured to or forms an integral part of the rear portion of the reciprocable shaft 29. The length of the gear 69 is selected in such a way that it remains in mesh with the gear segment 65 in each axial position of the shaft 29. The roller follower 67 tracks an endless surface or cam face in the cam groove 44.

As shown in FIG. 5, the discs or heart cams 47, 48 of the composite cam 46 are rotatable on the shaft 71 which, in turn, is rotatable in antifriction bearings 71*a*, 71*b* provided therefor in the walls 11 and 12 of the frame 3. The aforementioned one-way clutch 72 transmits torque from the camshaft 71 to the cylinder 49 of the cam 46 when the shaft 71 is driven to rotate clockwise (see the arrow 73), as viewed in FIGS. 1 to 3. The details of the clutch 72 are shown in FIGS. 5 and 6. It will be noted that the disc 48 is omitted in FIG. 6 and that the camshaft 71, together with the fasteners 50 which secure the components 47, 48 and 49 of the composite cam 46 to each other, is shown in section.

The clutch 72 comprises a sleeve 74 which is keyed to the camshaft 71, as at 75, intermediate the discs 47 and 48 (i.e., within the confines of the cylinder 49). The peripheral surface of the sleeve 74 has a recess 76 for a pawl 81 which is pivotably mounted on a pin 77 extending in parallelism with the camshaft 71. The pawl 81 is biased in a clockwise direction, as viewed in FIG. 6, by a helical spring 79, a portion of which extends into a blind bore 78 of the sleeve 74. The pallet 81*a* of the pawl 81 normally extends into a notch 82 which is machined into the internal surface of the cylinder 49 so that the pallet 81*a* bears against the surface 82*a* in the notch 82 and causes the cylinder 49 (and hence also the discs 47, 48) to rotate when the camshaft 71 is driven to rotate in the direction of the arrow 73. The pallet 81*a* merely rides over the innermost portion of the surface 82*b* in the notch 82 when the camshaft 71 is rotated in a clockwise direction, as viewed in FIG. 6.

The camshaft 71 receives torque from a rack and pinion drive including a gear 83 secured to the shaft 71 in the interior of the wall 11 and an elongated toothed rack 84 which meshes with the gear 83 and is movable relative to the frame 3, namely, up and down, as viewed in FIG. 1, 2 or 3. The front wall 11 of the frame 3 is preferably provided with a suitable passage wherein the rack 84 is guided during movement with respect to the wall 11.

The means for reciprocating the toothed rack 84 comprises an elongated strip-shaped control member 86 (indicated in FIG. 1 by phantom lines) which is movable with as well as relative to the carrier rail 21. The arrangement is such that the control member 86 can share the movements of the rail 21 (see the double-headed arrow 87 in FIG. 1) and that the control member 86 can move relative to the rail 21, at least in the raised position of the frame 1. The means for moving the control member 86 with and relative to the rail 21 includes the aforementioned prime mover of the spiral binding machine in which the apparatus of the present invention is put to use. The control member 86 is moved relative to the rail 21 in the raised position as well as in the lower end position of the frame 3.

The apparatus further comprises arresting means 88 serving to block movements of the composite cam 46 counter to the direction indicated by the arrow 73. The arresting means 88 comprises a pawl 92 which is biased by a helical spring 91 so that its pallet normally extends into a socket or notch 89 provided in the peripheral surface of the disc 47. The shaft for the pawl 92 is mounted on the wall 11 and/or 12. FIG. 2 shows that the shaft 92*a* for the pawl 92 constitutes the bolt for the distancing sleeve 16 which extends between the walls 11 and 12.

As mentioned hereinabove, a second apparatus which is a mirror image of the illustrated loop forming apparatus is installed in the spiral binding machine to treat the rear outermost convolution 101*a* of the foremost spiral binder 1 while the front outermost convolution 1*a* of such binder (which is held and located by the prongs 4*a*, 6*a* and shroud 41) is treated by the loop forming apparatus which is shown in the drawing. The frame of the second apparatus is mounted on the carrier rail 21, and the toothed rack of the second apparatus also derives motion from the control member 86. This ensures proper synchronization of movements of mobile parts of the illustrated loop forming apparatus with the movements of mobile parts in the second apparatus. The motion transmitting connection between the prime mover of the spiral binding machine on the one hand and the rail 21 and control member 86 on the other hand can comprise a system of levers, cams and/or analogous conventional elements which are not shown in the drawing.

The operation is as follows:

When the foremost stack 2 reaches the required position for looping of end portions 1*c*, 101*c* of the outermost convolutions 1*a*, 101*a* of the respective spiral binder 1, the rail 21 maintains the frame 3 in the lower end position, i.e., the locating means including the prongs 4*a*, 6*a* and the shroud 41 are distant from the foremost spiral binder 1. In the next step, the aforementioned motion transmitting mechanism of the spiral binding machine causes the frame 3 to move to the operative position of FIG. 5 so that the foremost binder 1 is properly located by the parts 4*a*, 6*a*, 41 preparatory to rotation of the shaft 28 in a direction to trim or clip and bend the end portion 1*c* of the foremost outermost convolution 1*a*. At the same time, the rear end portion of the same binder 1 is properly located by the components 4*a*, 6*a*, 41 (not shown) of the second loop forming apparatus. The motion transmitting mechanism of the spiral binding machine moves the frame 3 upwardly by way of the rail 21, and the control member 86 shares such upward movement of the rail 21, i.e., the parts 21 and 86 move as a unit upwardly and at right angles to the axis of the camshaft 71 which is parallel with the shafts 28 and 29.

When the frame 3 reaches the operative (upper end) position, the rail 21 remains stationary during the interval which is needed to convert the end portion 1*c* into a loop 1*d*, whereas the control member 86 moves relative to the rail 21 to displace the toothed rack 84 with respect to the front wall 11 so that the gear 83 rotates in the direction of the arrow 73. As can be seen in FIG. 2, such angular movement of the camshaft 71 necessitates an upward movement of the rack 84.

The gear 83 drives the shaft 71 which, in turn, drives the hollow cam 46 by way of the clutch 72 because the pallet 81*a* of the pawl 81 shown in FIG. 6 pushes the cylinder 49 which transmits torque to the discs 47 and 48 via fastener means 50. The upward stroke of the control member 86 with respect to the rail 21 (in the upper end position of the frame 3) is selected in such a way that the cam 46 completes a little more than one full revolution.

Figure 8A:
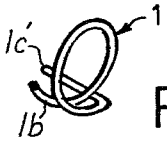
FIG. 8*a* is a perspective view of the outermost and neighboring convolutions of the spiral binder of FIG. 7, the end portion of the outermost convolution being shown in a position it assumes upon completion of the bending step.

During the first stage of clockwise rotation of the composite cam 46, as viewed in FIG. 2, the roller follower 52 in the endless groove 42 of the disc 47 causes the lever 51 to rotate the shaft 28 in a counterclockwise direction, as viewed in FIG. 2, whereby the knife 24 cooperates with the counterknife 36 to trim the surplus wire off the end portion 1*c* before the knife 24 begins to bend the trimmed end portion 1*c* around the edge 37 (see FIGS. 7 and 8) of the foremost prong 4*a*. As shown in FIG. 8*a*, the end portion 1*c* is bent over the outer side of the next-to-the-outermost convolution 1*b* so that it extends in substantial parallelism with the axis of the spiral binder 1. The follower 52 thereupon causes the lever 51 to return the shaft 28 to its starting angular position so that the knife 24 is remote from the bent end portion 1*c*′ (see FIG. 8*a*). The bent end portion 1*c*′ is then adjacent to the guide surface 38 and its inclination is such that it does not interfere with forward movement of the shaft 29, i.e., with movement of the end face 32 toward the surface 38 of the guide member 4.

The groove 43 of the rotating cylinder 49 causes (or can cause) the bifurcated portion of the lever 53 to move the shaft 29 axially and toward the guide surface 38 even before the shaft 28 for the mobile knife 24 completes its movement back to the starting position. This causes the convolution 1*a* or the convolution 1*b* (or portions of both of these convolutions) to enter the radially extending slot 33 of the shaft 29 (see FIG. 9) during the last stage of movement of the shaft 29 toward the surface 38. In the next step (but during the same revolution of the composite cam 46), the groove 44 of the disc 48 causes the roller follower 67 to pivot the lever 66 so that the gear segment 65 rotates the gear 69 and hence the shaft 29 in a direction to convert the bent end portion 1*c*′ of the outermost convolution 1*a* into a loop 1*d* (see FIGS. 9*a* and 10). The configuration of the groove 44 in the disc 48 is such that the shaft 29 is rotated through approximately 180 degrees and in a clockwise direction, as viewed in FIG. 9, whereby the provision of the recess 34 in communication with the inner end portion of the radially extending slot 33 in the end face 32 of the shaft 29 ensures that the latter cannot deform the convolution 1*a* and/or 1*b* during conversion of the bent end portion 1*c*′ into the loop 1*d*. Such counterclockwise rotation of the shaft 29 is followed by rotation in the opposite direction so that the convolution 1*a* and/or 1*b* leaves the recess 34 and permits retraction of the shaft 29 by the cam 49, i.e., by the bifurcated portion of the lever 53 which is then caused (by the follower 63) to move axially of the shaft 29 and in a direction toward the rear wall 12 so that the lever 53 bears against the stop 59 and pushes the latter toward the intermediate wall 18. The axial length of the gear 69 suffices to ensure that this gear remains in mesh with the gear segment 65 while the shaft 29 moves axially toward or away from the guide surface 38.

When the composite cam 46 has completed a little more than one full revolution, the motion transmitting mechanism of the spiral binding machine moves the rail 21 downwardly, together with the control member 86, so that the frame 3 descends and the parts 4*a*, 6*a*, 41 move away from the spiral binder 1 in the foremost stack 2 of paper sheets. The control member 86 continues to move downwardly after the rail 21 reassumes its lower end position so that the descending toothed rack 84 rotates the gear 83 in a counterclockwise direction, as viewed in FIG. 3. As mentioned before, the cam 46 was rotated (in the direction of the arrow 73) through a little more than one full revolution; therefore, the pallet of the pawl 92 was expelled from the notch 89 in the periphery of the disc 47. Friction between the elements of the clutch 72 causes the cam 46 to rotate counter to the direction indicated by the arrow 73 during the first stage of downward movement of the control member 86 and rack 84 relative to the rail 21 (which has already reassumed its lower end position). Such friction-induced rotation of the composite cam 46 is terminated when the pallet of the pawl 92 reenters the notch 89, i.e., the composite cam 46 reassumes its starting angular position and the apparatus is ready to treat the next spiral binder (see the binder 1A of FIG. 1). The length of downward stroke of the control member 86 and rack 84 relative to the rail 21 is selected in such a way that the camshaft 71 completes a little more than one revolution (in a counterclockwise direction, as viewed in FIG. 2) after the pallet of the pawl 92 reenters the notch 89 of the disc 47. Therefore, the pallet 81*a* of the pawl 81 reenters the notch 82 or penetrates into such notch immediately after the camshaft 71 begins to rotate in the direction of the arrow 73.

The improved apparatus is susceptible of many modifications without departing from the spirit of the invention. For example, the device 7 can be designed to serve solely as a trimming or solely as a bending means for the end portion 1*c* of the outermost convolution 1*a*. In such apparatus, the trimming or bending is carried out by a separate device which can be actuated by a further cam, preferably a cam which is coaxial with the components of the composite cam 46 and shares the angular movements of such components. All that is necessary is to configurate the groove in the further cam in such a way that the movements of discrete trimming and bending devices are properly synchronized. The provision of a combined trimming or clipping and looping device is preferred at this time because it contributes to simplicity and compactness of the improved apparatus.

An important advantage of the improved apparatus is that it need not be provided with a discrete mobile hold-down device for the outermost convolution 1*a* and/or the neighboring next-to-the-outermost convolution 1*b* of a spiral binder 1 or 1A which is held in the predetermined position, i.e., in a position in which the end portion of the outermost convolution is ready for trimming, bending and looping. The device 8 serves as a hold-down means in that the end face 32 of the shaft 29 cooperates with the guide surface 38 to define a channel for looping of the bent end portion 1*c*′ therein, and the device 8 also constitutes the looping means in that the shoulder 31 engages the bent end portion 1*c*′ and causes it to form the aforediscussed loop 1*d*.

Another important advantage of the improved apparatus is that it is capable of properly looping the end portions of larger-, smaller- or medium-diameter convolutions. Thus, all that is necessary is (a) to furnish the loop forming apparatus with several shafts 29, each of which is capable of looping the end portion of a given outermost convolution, namely, an outermost convolution having a given diameter or range of diameters. The shaft 29 can be readily removed from the frame 3. As shown in FIG. 3, the shaft 29 can be withdrawn by the simple expedient of loosening the single screw 58*a* which fixes the stop 58 and by loosening the single screw 59*a* which fixes the stop 59 to the intermediate portion of this shaft. Also, it is necessary (b) to furnish the loop forming apparatus with appurtenant sets of plates 4, 6 and combined trimming or clipping and bending devices. The plates 4 and 6 can be readily attached to or separated from the frame 3 for replacement by plates whose prongs 4*a*, 6*a* can support and locate different types of spiral binders, i.e., spiral binders consisting of larger- or smaller-diameter wire and/or spiral wire binders having convolutions of larger or smaller diameter. It is also possible to merely adjust the positions of the plates 4 and 6 so that one and the same pair of plates can adequately locate different types of spiral wire binders. The same holds true for the mobile knife 24, i.e., this knife can be readily adjusted axially of the shaft 28 and/or otherwise to enable it to properly clip and/or bend different types of convolutions. Still further, the shroud 41 can be adjusted by replacing the illustrated distancing element 39 with a different distancing element. Also, the shroud 41 can be replaced with a differently configurated and/or dimensioned shroud if the diameter of the spiral binder is changed.

The means for separably or adjustably securing the shroud 41 to the frame 3 includes the distancing element 39 and the screw(s) or bolt(s) for removably affixing the element 39 to the frame 3 or to another component of the apparatus. The means for separably and/or adjustably affixing the plates 4 and 6 to the frame 3 includes screws or bolts 4f, 6f or analogous attaching means.

A further advantage of the improved loop forming apparatus is that, when the front end portion of the shaft 29 is moved toward the surface 38 of the guide member 4, i.e., when the cam 49 moves the shaft 29 to its extended position, the front end face or surface 32 of the shaft 29 tends to straighten out the bent end portion 1*c*′ of the outermost convolution 1*a* by tending to eliminate that curvature of the bent end portion 1*c*′ which is attributable to the helical shape of the convolutions of a wire binder, whereby the bent end portion 1*c*′ bears against the end face 32 and is even less likely to slide off the shoulder 31 when the shaft 29 is rotated to loop the end portion 1*c*′ around the neighboring convolution 1*b*. In other words, the front end portion of the shaft 29 (in the extended position of such shaft) subjects the bent end portion 1*c*′ to a deforming stress which acts in a direction to maintain the end portion 1*c*′ in contact with the shoulder 31 as well as with the end face 32 while the shaft 29 rotates clockwise, as viewed in FIG. 9, to thereby convert the end portion 1*c*′ into a loop 1*d*.

Another important advantage of the improved loop forming apparatus is that the means for moving the knife 24 (so as to clip and thereupon bend the end portion 1*c* of the outermost convolution), the means for moving the shaft 29 axially toward and away from the surface 38, as well as the means for rotating the shaft 29 include rotary cams. This is in contrast to heretofore known loop forming apparatus wherein the various mobile constituents receive motion from pivotable or reciprocable cams or the like. A drawback of such conventional moving and/or rotating means is that the devices which trim, bend and loop the end portion of the outermost convolution must carry out a given series of steps in a first sequence in order to convert the end portion of an outermost convolution into a loop, and that such devices thereupon perform the same series of steps but in the reverse order for the purpose of returning the respective devices to their starting positions. This is undesirable for several reasons, namely, because the mobile constituents undergo excessive wear, because the means for moving and/or rotating takes up an excessive amount of space, and also because it prolongs the interval during which the apparatus must be held in the operative position. In other words, the interval which elapses for the making of a loop is much longer than necessary because such interval includes a first portion of actual making of the loop and a second portion (of identical length) of movement of various mobile constituents back to their starting positions so as to allow for disengagement of the loop forming apparatus from the finished spiral wire binder and introduction of the next binder to a position in which the end portions of its outermost convolutions can be converted into closed or open loops. On the other hand, a modern spiral binding machine is capable of turning out a large number of products per unit of time, namely, a number which greatly exceeds the number of spiral wire binders with end convolutions having looped end portions which can be produced with heretofore known loop forming apparatus per unit of time. Therefore, whenever a modern high-speed spiral binding machine embodies conventional loop forming apparatus, such apparatus constitute a bottleneck which prevents the machine from operating at full speed. This is avoided if the machine is equipped with the loop forming apparatus of the present invention because the means for moving various mobile devices are cams which simply rotate in one and the same direction to effect the making of a looped end portion during each revolution of such cams. The reason for shortening of the loop formation by resorting to the apparatus of the present invention will be readily appreciated by bearing in mind that the components 47, 48 and 49 of the composite cam 46 rotate in a single direction (arrow 73) during movement of the devices 7 and 8 from and back to their starting positions. In other words, it is not necessary to reverse the direction of movement of the means which impart motion to the devices 7 and 8. It is true that the shafts 28 rotate back and forth, and that the shaft 29 also moves back and forth; however, such movements take place while the cams 47–49 rotate in one and the same direction. The knife 24 can be returned to its starting position immediately upon completion of the bending step, i.e., the configuration of the endless groove 42 in the disc cam 47 can be such that the knife 24 reassumes its starting position long before the composite cam 46 completes a full revolution. This allots a substantial interval of time during which the shaft 29 of the device 8 can move forwardly to the extended position and thereupon rotates to convert the bent end portion 1*c*′ into a loop 1*d*. In other words, a large portion of the interval which is required to rotate the composite cam 46 through one full revolution can be devoted to conversion of the bent end portion 1*c*′ into a loop.

The frame 3 can be moved away from the finished product 102 immediately after the making of a loop 1*d* is completed, i.e., the rail 21 can begin to move downwardly, as viewed in FIG. 1, as soon as the camshaft 71 completes one revolution in the direction of arrow 73. As mentioned above, conventional loop forming apparatus are designed in such a way that their loop forming, bending, clipping, hold-down and/or other devices must be moved backwards to reassume their starting positions by reversing the direction of movement of cams or other moving means therefor. Consequently, each cycle is much longer than in a machine which embodies the loop forming apparatus of the present invention.

The placing of all three cams of the composite cam 46 end-to-end so that they can rotate about a common axis further contributes to simplicity, compactness, reliability and lower cost of the driving unit for the devices 7 and 8. The one-way clutch 72 renders it possible to rotate the cams 47–49 in a single direction, i.e., there is no need to reverse the direction of rotation of these cams upon completion of a loop or while the frame 3 dwells in the inoperative position. The arresting means 88 guarantees that all mobile parts assume their predetermined optimum starting positions before the control member 86 is again caused to move the toothed rack 84 upwardly so as to rotate the camshaft 71 in the direction of the arrow 73. The pawl 92 of the arresting means 88 allows the one-way clutch 72 to rotate the cams 47–49 by friction (counter to the direction indicated by arrow 73) only to the extent which is needed to invariably return the composite cam 46 to its predetermined starting position.

Additional savings in space are achieved due to the fact that the axis of the camshaft 71 is parallel to the axes of the shafts 28 and 29. Further savings in space are achieved by utilizing a hollow drum-shaped composite cam 46 which can confine the one-way clutch 72 in its interior and which has cam grooves in its end faces (namely, in the exposed outer sides of the discs 47, 48) as well as in its peripheral surface (i.e., in the periphery of the cylinder 49). The lever 53 need not pivot at all; this lever must move in the axial direction of the camshaft 71 so as to enable the shaft 29 to move forwardly and backwards (toward and away from the guide surface 38). The other two levers (51 and 66) are pivotably mounted because they serve to rotate the shafts 28 and 29.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In an apparatus for looping the end portion of the outermost convolution around the neighboring convolution of a spiral wire binder whose convolutions extend through the marginal perforations of a stack of sheets, the combination of means for locating the binder in a predetermined position; guide means having a first surface at least a portion of which is located in a predetermined plane; means for bending the end portion of the outermost convolution of the binder in said position outwardly of and over the neighboring convolution so that the thus bent end portion is adjacent to said portion of said surface; means for looping the thus bent end portion around the neighboring convolution of the binder in said position, including a device movable toward and away from said portion of said surface to and from an extended position of engagement with the bent end portion of the outermost convolution, said device being rotatable about a predetermined axis which is inclined with respect to the axis of the binder in said position and is substantially normal to said predetermined plane; means for moving said device toward and away from said portion of said surface; and means for rotating said device about said predetermined axis while said device engages the bent end portion to thereby loop such end portion along said portion of said surface and around the neighboring convolution of the binder in said position.

2. The combination of claim 1, wherein said portion of said surface is substantially flat, at least in the region which is adjacent to the bent end portion of the outermost convolution of a binder in said position.

3. The combination of claim 1, wherein said device includes a wire-engaging portion which loops the bent end portion of the outermost convolution in the extended position of said device in response to rotation of said device about said predetermined axis.

4. The combination of claim 3, wherein said device includes a shaft which is movable axially by said moving means and is rotatable by said rotating means, said shaft having a first end portion nearer to and a second end portion more distant from said portion of said surface, said wire-engaging portion being eccentric to said shaft and being provided on said first end portion.

5. The combination of claim 4, further comprising a frame for said looping means, said frame including bearing means for said shaft.

6. The combination of claim 1, wherein said device has a wire-engaging portion including a loop forming shoulder disposed in a plane which is substantially normal to said portion of said surface.

7. The combination of claim 6, wherein said device includes a shaft comprising an end portion which constitutes said wire-engaging portion, said end portion of said shaft having an end face which is substantially parallel with said portion of said surface and said shoulder extending from said end face in a direction toward said portion of said surface.

8. The combination of claim 1, wherein said device includes a second surface which is spaced from said portion of said first surface and defines therewith a channel wherein the bent end portion of the outermost convolution of a binder in said position is looped in response to rotation of said device in the extended position thereof.

9. The combination of claim 1, wherein at least one of said rotating and moving means comprises rotary cam means.

10. The combination of claim 1, wherein said moving means comprises first rotary cam means and said rotating means comprises second rotary cam means.

11. The combination of claim 10, further comprising second moving means which is actuatable to move said bending means relative to the binder in said position, said second moving means including additional rotary cam means.

12. The combination of claim 10, wherein said first cam means includes a component arranged to move said device from a retracted position to said extended position and back to said retracted position in response to one revolution of said first cam means.

13. The combination of claim 12, wherein said second cam means includes means for rotating said device from a starting angular position and back to such starting position in response to one revolution of said second cam means.

14. The combination of claim 13, further comprising third rotary cam means arranged to move said bending means from a starting position and back to such starting position in response to one revolution of said third cam means.

15. The combination of claim 14, wherein said first, second and third cam means are rotatable about a common axis.

16. The combination of claim 10, wherein one of said cam means includes a rotary component having an endless cam face and follower means tracking said cam face.

17. The combination of claim 10, wherein one of said cam means includes a cylindrical component having an endless peripheral cam face and follower means tracking said cam face.

18. The combination of claim 10, wherein said cam means are coaxial and each thereof has an endless cam groove and follower means extending into and tracking the respective groove.

19. The combination of claim 18, wherein one of said cam means has an end face and the other of said cam means has a peripheral surface, one of said cam grooves being provided in said end face and the other of said cam grooves being provided in said peripheral surface.

20. The combination of claim 10, further comprising means for rotating said cam means about a common axis, said rotating means including means for driving said cam means in a single direction.

21. The combination of claim 20, wherein said driving means includes a rack and pinion drive and one-way clutch means interposed between said drive and said cam means.

22. The combination of claim 21, wherein said drive includes a reciprocating toothed rack and a gear meshing with said rack and coaxial with said cam means, said one-way clutch means including a freewheel interposed between said gear and said cam means.

23. The combination of claim 21, wherein at least one of said cam means is hollow and said clutch means is confined in said hollow cam means.

24. The combination of claim 20, further comprising means for releasably arresting said cam means in a predetermined starting position after each revolution thereof.

25. The combination of claim 24, wherein said arresting means includes means for blocking rotation of said cam means in one direction.

26. The combination of claim 20, wherein said device comprises a rotary shaft and said common axis is parallel to the axis of said shaft, and further comprising a common frame for said shaft and said cam means.

27. The combination of claim 1, wherein said moving means comprises a rotary cam having a peripheral cam groove and a follower extending into said groove and operatively connected with said device to move said device axially in response to rotation of said cam.

28. The combination of claim 27, wherein said cam is rotatable about an axis which is parallel to said predetermined axis and said groove is configurated to move said follower in parallelism with the axes of said cam means and said device.

29. The combination of claim 27, further comprising means for transmitting motion from said cam to said device, said device including a shaft and said motion transmitting means comprising two spaced-apart stops provided on said shaft, a member connected with said follower and resilient means reacting against one of said stops and urging said member against the other of said stops.

30. The combination of claim 29, wherein said member includes a portion extending between said stops.

31. The combination of claim 30, wherein said portion of said member is bifurcated and straddles said shaft intermediate said stops.

32. The combination of claim 1, wherein said device comprises a shaft and said rotating means includes a rotary cam and follower means tracking said cam and operatively connected with said shaft to rotate the shaft in response to rotation of said cam.

33. The combination of claim 32, wherein said cam has an end face provided with an endless cam groove, said follower means including a lever having a portion extending into and tracking said groove.

34. The combination of claim 33, wherein said follower means further comprises a first gear fixed to said shaft and a second gear mating with said first gear and pivotable with said lever to thereby rotate said first gear and said shaft.

35. The combination of claim 34, wherein said second gear is a segment.

36. The combination of claim 1, further comprising means for pivoting said bending means to and from a predetermined starting position, including a shaft rotatable about fixed axis, a cam rotatable about a further axis parallel to said fixed axis, and means for transmitting motion from said cam to said shaft, said motion transmitting means including follower means tracking said cam and coupled with said shaft.

37. The combination of claim 36, wherein said follower means includes a lever fixed to said shaft and having a portion extending into an endless groove provided in said cam.

38. The combination of claim 1, wherein said device includes a first shaft and said means for rotating said device comprises a second shaft parallel to said first shaft and provided with a first gear, said first shaft including a second gear mating with said first gear so that said first shaft rotates in response to rotation of said second shaft.

39. The combination of claim 1, wherein said means for rotating and said means for moving include coaxial cams, one of said cams including a heart cam and the other of said cams including a cylindrical groove cam.

40. The combination of claim 1, further comprising a frame and means for separably securing at least a portion of said locating means to said frame.

41. The combination of claim 1, wherein said locating means includes several discrete portions and said securing means includes devices for separably securing each of said discrete portions of said locating means to said frame.

42. The combination of claim 1, further comprising a frame and means for adjustably securing at least a portion of said locating means to said frame.

43. The combination of claim 1, further comprising a frame and means for releasably securing said device in said frame for movement toward and away from said portion of said surface and for rotation about said predetermined axis.

44. The combination of claim 43, wherein said means for releasably securing includes at least one disc and means for fastening said disc to said device.

45. The combination of claim 43, wherein said device is a substantially cylindrical shaft.

46. The combination of claim 1, wherein said device includes a portion which constitutes an elongated pinion and further comprising a frame having wall means wherein said device and its pinion are journalled for reciprocatory and angular movement with reference to said frame.

* * * * *